US005485874A

United States Patent [19]

Whitmore

[11] Patent Number: 5,485,874

[45] Date of Patent: Jan. 23, 1996

[54] VENETIAN BLIND

[76] Inventor: William F. Whitmore, 3452 Osborn Dr., Modesta, Calif. 95350

[21] Appl. No.: 229,163

[22] Filed: Apr. 18, 1994

[51] Int. Cl.[6] ..... E06B 3/48

[52] U.S. Cl. ..... 160/115; 160/176.1; 160/178.3

[58] Field of Search ..... 160/115, 168.1 R, 160/178.1 R, 167 R, 173 R, 176.1 R, 178.3 R, 236

[56] References Cited

U.S. PATENT DOCUMENTS

| | | | |
|---|---|---|---|
| 2,276,425 | 3/1942 | Slattery | 160/115 X |
| 2,290,634 | 7/1942 | Clark, Jr. | 160/178.3 |
| 2,517,788 | 8/1950 | Herron | 160/178.3 |
| 2,836,237 | 5/1958 | Hogin et al. | 160/115 |
| 4,200,135 | 4/1980 | Hennequin | 160/168 A |
| 4,377,194 | 3/1983 | Tsuhako | 160/168 R |
| 4,484,612 | 11/1984 | Vecchiarelli | 160/177 |
| 4,572,267 | 2/1986 | Stein et al. | 160/176 R |
| 4,621,672 | 11/1986 | Hsu | 160/115 |
| 4,763,713 | 8/1988 | Kraus | 160/178.3 X |
| 4,768,576 | 9/1988 | Anderson | 160/107 |
| 4,917,168 | 4/1990 | Chen | 160/176.1 |
| 4,926,921 | 5/1990 | Heinemann et al. | 160/115 |
| 4,947,921 | 8/1990 | Chun-Cheng | 160/176.1 |
| 4,955,248 | 9/1990 | Lindstrom | 74/424.5 |
| 4,984,617 | 1/1991 | Corey | 160/84.1 |
| 5,119,868 | 6/1992 | Werner | 160/115 |

*Primary Examiner*—Blair M. Johnson
*Attorney, Agent, or Firm*—Larry Uland; H. Dennis Kelly; Timmons & Kelly

[57] ABSTRACT

An improved venetian blind for controlling the amount of light which passes through an opening. The venetian blind of the present invention includes a control housing mounted substantially adjacent to an opening, means for selectively limiting the amount of fight passing through a first region of the opening, and means for selectively limiting the amount of light passing through a second region of the opening. Various embodiments of the invention are illustrated.

10 Claims, 5 Drawing Sheets

VENETIAN BLIND

RELATED DISCLOSURE

This is related to a disclosure fried with the U.S. Patent and Trademark Office as part of the Disclosure Document Program on Apr. 9, 1992, having Ser. No. 302,460.

BACKGROUND OF THE INVENTION

The present invention relates to devices for controlling an amount of light which is allowed to come through an opening such as a window or glass door, and more particularly concerns a venetian blind for partially covering such an opening and thereby controlling the amount of light passing through the opening.

Many devices have been proposed in the prior art for controlling the amount of light coming through an opening, and include many varieties of venetian blinds which incorporate means to vary the size of the area of the opening over which said blinds have control. Examples of such devices can be found in the following U.S. Pat. Nos. 2,914,122 and 2,994,370 by Pinto; U.S. Pat. No. 4,200,135 by Hennequin; U.S. Pat. No. 4,377,194 by Tsuhako; U.S. Pat. No. 4,484,612 by Vechiarelli; U.S. Pat. No. 4,572,267 by Stein et al.; and U.S. Pat. No. 4,768,576 by Anderson; U.S. Pat. No. 4,788,188 by Blytheway, Jr.; and U.S. Pat. No. 4,955,248 by Lindstrom. While these and other examples of venetian blind devices of the prior art may be suitable for a particular purpose to which they address, it will be apparent to those skilled in the art that said devices would not be as suitable for the purposes of the present invention, which include providing means to control separately the a_mount of light passing through different regions of an opening. An example of a situation in which a need for this type device exists, is when an individual desires to block a substantial amount of light passing through a lower region of a window for privacy, while simultaneously desiring a significantly greater amount of light to pass through an upper region of the window for either viewing through said upper region or for illuminating an area behind the window.

SUMMARY OF THE INVENTION

In view of the foregoing and other disadvantages inherent in the known types of venetian blind devices now present in the art, the invention disclosed herein provides an improved venetian blind for controlling an amount of light passing through an opening. The venetian blind of the present invention includes means for selectively limiting the amount of light passing through different regions of an opening. Upon a closer review of the more detailed description herein, those skilled in the art will recognize that the concepts of the present invention easily overcome the problem described above which has been heretofore commonly associated with venetian blind devices. As such, the general purpose of the present invention is to provide a new and improved venetian blind which has all the advantages of the prior art and none of the disadvantages.

It is an additional object of the present invention to provide a new and improved venetian blind which can be used to control simultaneously the amount of light passing through at least two separate regions of an opening.

It is a further object of the present invention to provide a new and improved venetian blind including means for adjusting the size of an opening covered by each of at least two separate regions of the blind.

It is a further object of the present invention to provide a new and improved venetian blind which can be used to limit severely the amount of light passing through a selected portion of an opening for providing an amount of privacy thereby, while simultaneously allowing a significantly greater amount of light to pass through a different portion of the opening for illuminating the area behind the opening.

It is another object of the present invention to provide a new and improved venetian blind which may be easily and efficiently manufactured, marketed and installed.

It is still a further object of the present invention to provide a new and improved venetian blind which is of durable and reliable construction.

It is yet still a further object of the present invention to provide a new aped improved venetian blind which meets all federal, state, local and other private standards, guidelines, regulations and recommendations with respect to safety, environmental friendliness, energy conservation, etc.

An even further object of the present invention is to provide a new and improved venetian blind which is susceptible of a low cost of manufacture with regard to both materials and labor and which accordingly is then susceptible of low prices of sale to the consuming public, thereby making such a venetian blind economically available to the buying public.

These together with other objects of the invention, along with the various features of novelty which characterize the venetian blind of the present invention, are pointed out with particularity in the claims appended hereto and forming a part of this disclosure. The more important objects of the present invention have been outlined rather broadly in order that the detailed description thereof which follows may be better understood, and in order that the present contribution to the art may be better appreciated. For a better understanding of the invention, its operational advantages and the specific objects attained by its uses, reference should be made to the accompanying drawing and descriptive matter in which there are illustrated various embodiments of the invention.

Those skilled in the art will readily ascertain, however, that the invention is capable of other embodiments and of being practiced and carried out in various ways. In this respect, the details of construction disclosed herein, and the arrangements of the components set forth in the following description and appended drawings are for illustrative purposes, only, and are not intended to be limiting in scope. Those skilled in the art will appreciate, as well, that the conception upon which this disclosure is based, may be readily utilized as a basis for the designing of other structures, methods and systems for carrying out the several purposes of the present invention. Said other structures may include, but are not limited to, those which are aesthetic in nature, or those which include the substitution of other materials as they become available, and which substantially perform the same function in substantially the same manner with substantially the same result as the present invention. It is important, therefore, that the claims appended hereto be regarded as including such equivalent structures, constructions, methods and systems insofar as these do not depart from the spirit and scope of the present invention.

BRIEF DESCRIPTION OF THE DRAWINGS

The invention will be better understood and objects other than those set forth above will become apparent when consideration is given to the following detailed description.

Such description makes reference to the appended drawings, wherein.

DETAILED DESCRIPTION OF VARIOUS EMBODIMENTS

Figure 1:
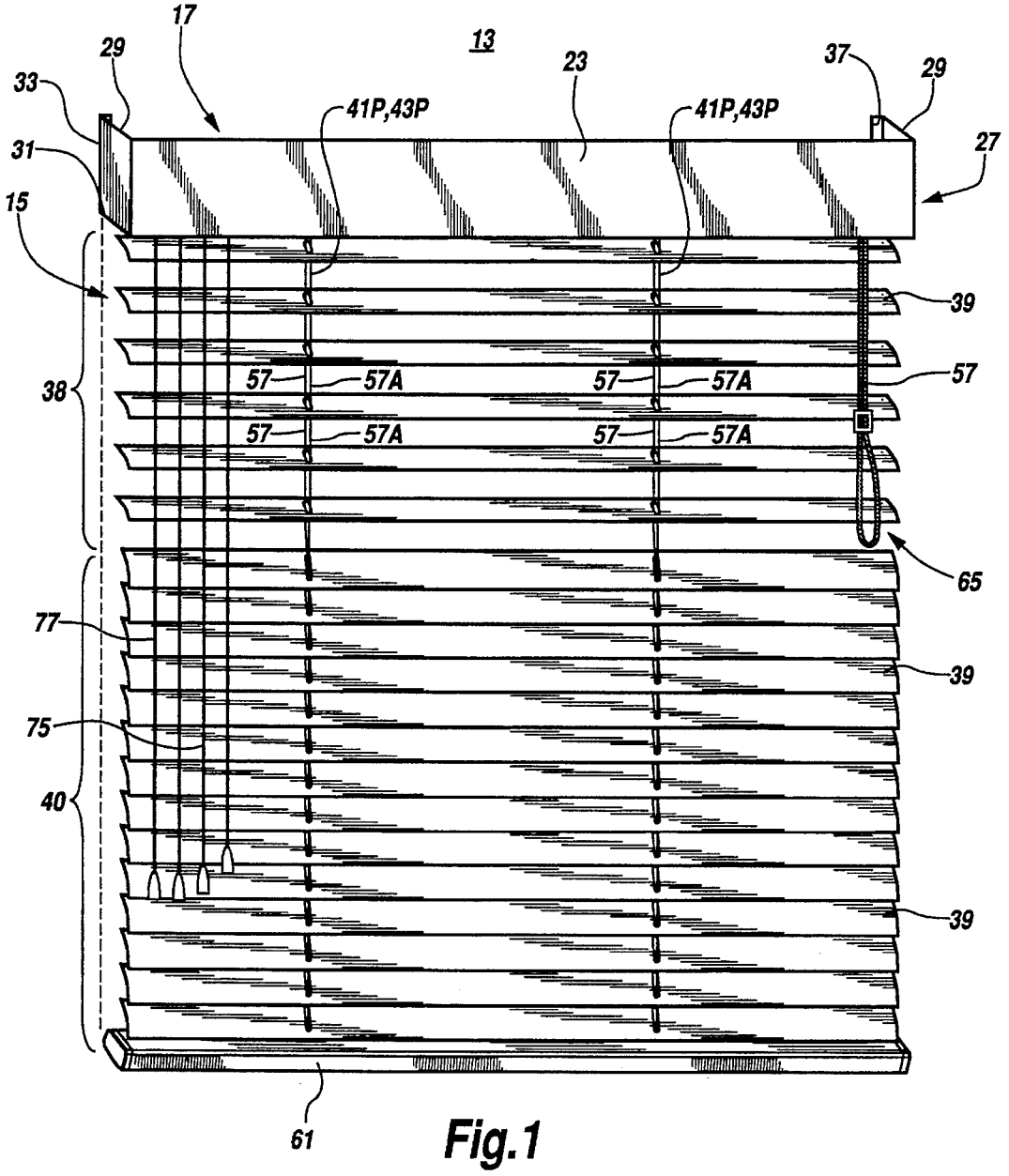
FIG. 1 is a front perspective view of an embodiment of a venetian blind according to the present invention.
Figure 2:
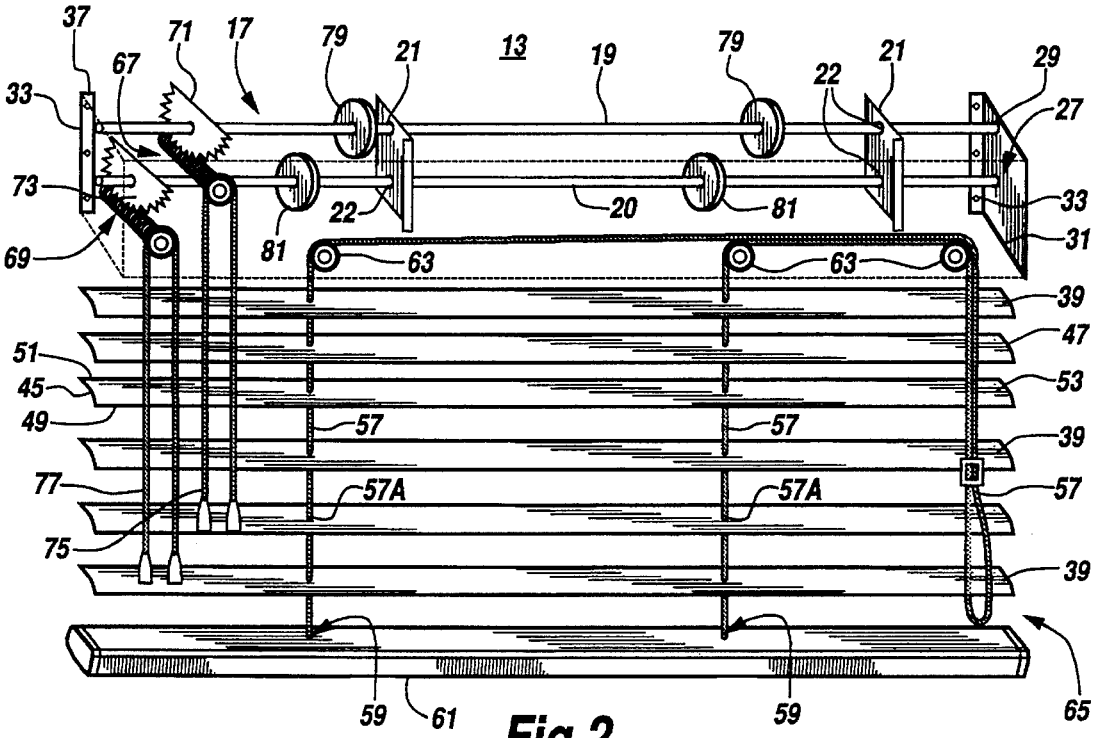
FIG. 2 is a partial front section view of the venetian blind of FIG. 1, minus some control cords.
Figure 3:
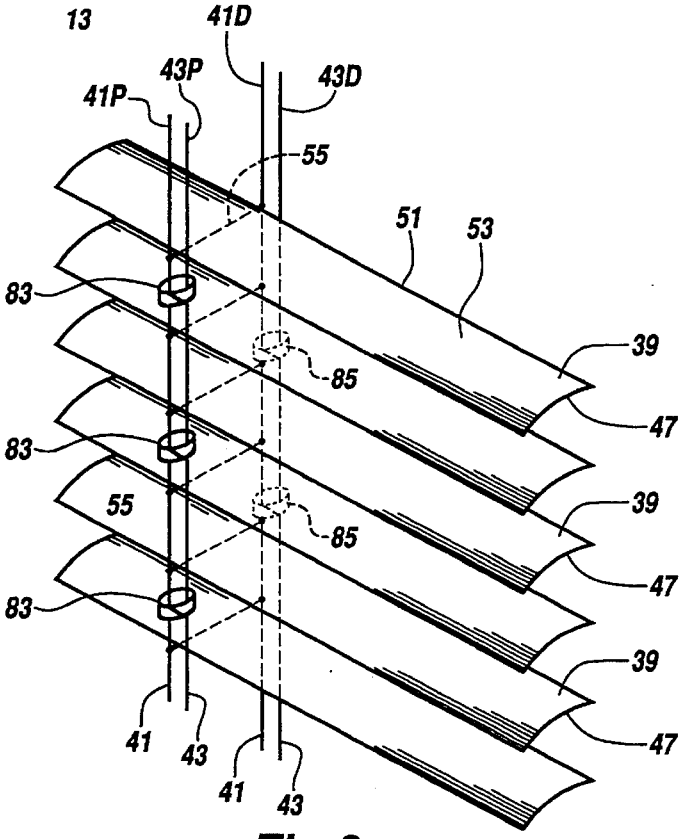
FIG. 3 is a partial section view of the venetian blind of FIG. 1, illustrating some of the control cords absent from the view of FIG. 2.
Figure 4:
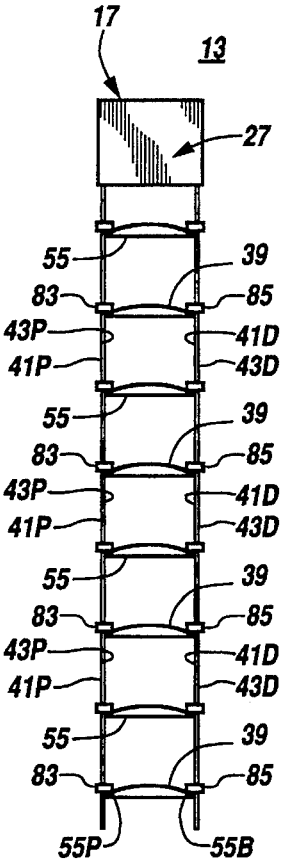
FIG. 4 is a partial side elevation view of the venetian blind of FIG. 3.
Figure 5:
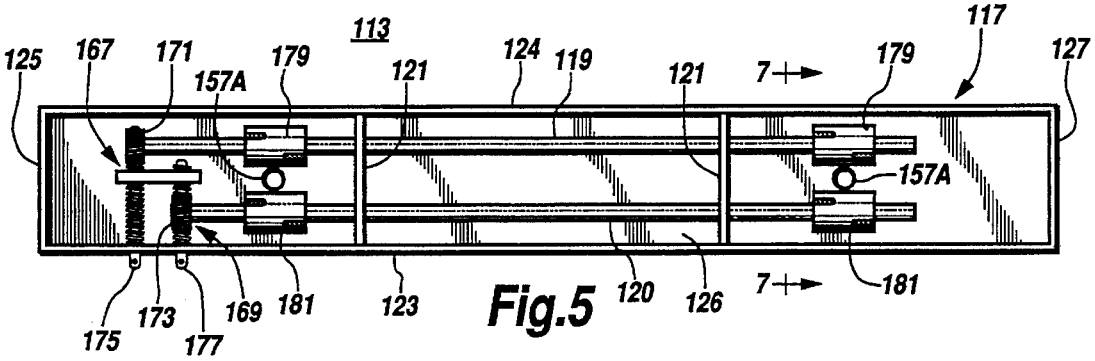
FIG. 5 is a top elevational view of an alternate embodiment of the venetian blind according to the present invention.
Figure 6:
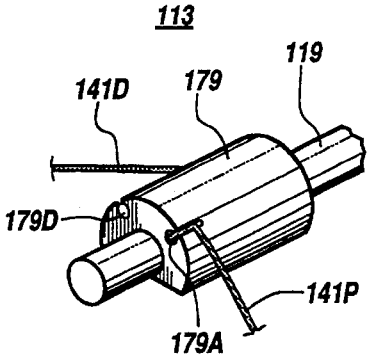
FIG. 6 is a perspective view of a control cord attachment element of the venetian blind of FIG. 5.
Figure 7:
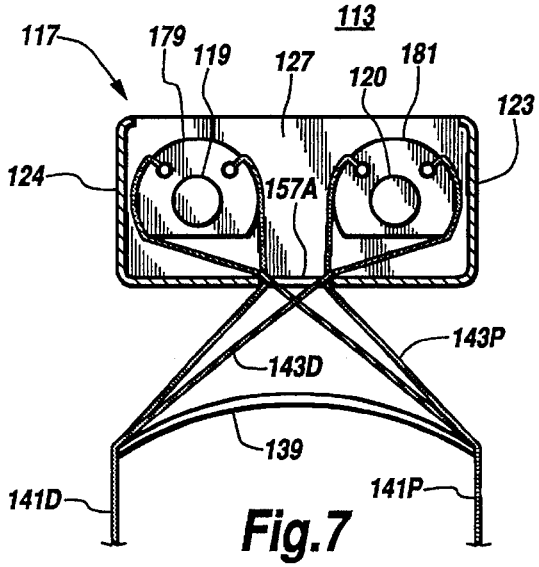
FIG. 7 is a section view of the venetian blind of FIG. 5, along lines 7—7.
Figure 8:
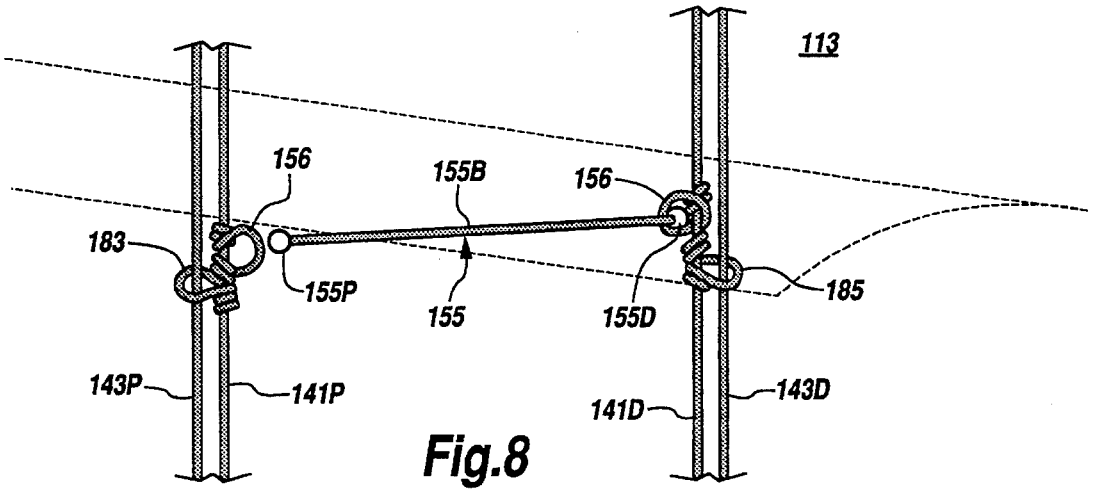
FIG. 8 is a partial front perspective view of an alternate embodiment of a pair of control cords and a horizontal connecting cord for a venetian blind according to the present invention.

The present invention comprises an improved venetian blind for controlling the mount of light which passes through an opening. The venetian blind of the present invention includes a control housing mounted substantially adjacent to an opening, means for selectively limiting the mount of light passing through a first region of the opening, and means for selectively limiting the amount of light passing through a second region of the opening. Various embodiments of the invention are illustrated in the appended drawings and described in greater detail, below. (All like numerical designations in the figures represent the same element, while similar numerical designations represent similar elements.)

FIGS. 1 through 4 illustrate an embodiment of a venetian blind 13 according to the present invention, for selectively controlling the amount of light passing through an opening 15. Included in the venetian blind 13 is a control housing 17 attached to an upper edge (not shown) of the opening 15, a first control bar 19 and a parallel second control bar 20 in rotatable communication with suitable control bar mounting means, such as the planular bar mounts 21 affixed to the distal surface of an elongate side 23 of the control housing 17, each of said bar mounts 21 having at least a pair of apertures 22 therethrough for engaging the first and second control bars 19 and 20. The control bars 19 and 20 are in a vertical plane which substantially bisects the control housing 17. The elongate side 23 is connected at each end to the proximate edges of a first housing end 25 and a second housing end 27. Further included in each housing end 25 and 27 are substantially parallel lower and upper edges 29 and 31, each of which has a distal end for connecting to a distal edge 33 of each control housing end 25 and 27. Each of the housing end distal edges 33 is further affixed to a mounting bracket 37 for attaching to the upper edge of the opening 15.

Still further provided in the venetian blind of the present invention is first means for selectively limiting the amount of light passing through a first region 38 of the opening 15 and second means for selectively limiting the amount of light passing through a second region 40 of the opening 15; each of said first or second light limiting means acting independent of the other. In the illustrated embodiment of the venetian blind 13, each of said first and second light limiting means includes a plurality of co-planar, horizontal and parallel longitudinal slats 39 in communication with a first and second set of vertically oriented light-limiting control cords 41 and 43, respectively, Each of the longitudinal slats 39 is substantially equivalent in size and has a first end 45, a second end 47, a proximate longitudinal edge 49, a distal longitudinal edge 51, an upper surface 53 and a lower surface (not shown). Each of the first and second sets of light limiting cords 41 and 43 includes at least a proximate cord (41P or 43P) in communication with the proximate edges 49 of the slats 39, and a distal cord (41D or 43D) in communication with the distal edges 51 of said slats 39.

Each of the first or second light limiting means of the venetian blind of the present invention further includes means for selectively retaining the plurality of longitudinal slats 39 in at least a first or a second linear array, respectively corresponding to said first region 38 or second region 40 of the opening 15. In the illustrated embodiment of the venetian blind 13, said retaining means includes a plurality of horizontal connecting cords 55 for connecting at regular intervals each of the proximate control cords 41P and 43P to the corresponding distal control cord 41D or 43D. Each of the horizontal connecting cords 55 further includes a proximate end 55P affixed to either of the corresponding proximate control cords 41P or 43P, a distal end 55D affixed to either of the corresponding distal control cords 41D or 43D, and a linear cord body 55B which is substantially as long as each longitudinal slat 39 is wide, for allowing one of said slats 39 to rest thereon. The connecting cords 55 are made of material substantially similar to that of the control cords 41 and 43, and are affixed to said control cords via affixing means which are well known. Each set of control cords 41 and 43 has said plurality of horizontal connecting cords 55 affixed thereto in a region of the blind 13 wherein the corresponding control cord 43 or 41 has no connecting cords 55, for allowing each set of control cords 41 or 43 to control a separate linear array of slats 39.

Each of the first or second light limiting means of the present invention further includes means for selectively collapsing the first or second linear array of slats 39. Said collapsing means of the illustrated embodiment of the venetian blind 13 comprises a lifting cord 57 in communication with each slat 39 through at least a lifting cord aperture 57A in each slat 39 located substantially along the longitudinal axis of each slat 39, said lifting cord 57 being affixed at a first end 59 to the lowest slat 61 of the blind 13, via means which are well known. The lifting cord 57 is further in communication with pulley means 63 affixed to the distal surface of the elongate side 23 of the control housing 17, such that said lowest slat 61 is pulled toward the control housing 17 by the lifting cord 57 when a second end 65 of the lifting cord 57 is pulled away from said housing 17. Means for locking the lifting cord in place relative to said pulley means 63 is further provided (not shown), said means being well known in the art. It is preferred that said lowest slat 61 include a greater mass than the slats 39, for assuring that said slat 61 falls away from the control housing 17 under the force of gravity when the lifting cord is released by said locking means, and the first end 59 of the lifting cord 57 is thereby allowed to follow the remaining portion of the lifting cord 57 and move toward said housing 17.

Still further included in each of the first or second light limiting means of the venetian blind according to the present invention is means for selectively varying the amount of light passing between the slats of the corresponding first or second linear array of slats. In the illustrated embodiment of the venetian blind 13, said varying means includes first and second means for rotating the corresponding first or second control bar (19 or 20) about its longitudinal axis. Said first and second rotating means includes a first and second pulley with worm gear 67 and 69, for engaging a corresponding first and second worm driving wheel 71 and 73. Each of said driving wheels 71 and 73 is co-axially affixed to the corresponding first or second control bar 19 or 20, such that when either the first or second pulley with worm gear 67 or 69 is rotated, the corresponding first or second driving wheel causes the corresponding first or second control bar 19 or 20 to rotate about its axis. A first and a second worm gear pulley cord 75 and 77 is further provided for engaging the corresponding first and second pulley with worm gears 67 and 69.

Said first and second light limiting means further includes a first and second pair of control cord driving wheels 79 and 81, each of which is co-axially affixed to the corresponding first or second control bar 19 or 20. An upper end (not shown) of each control cord of the first set of control cords 41 is connected to one of the first control cord driving wheels 79, such that each proximate control cord 41P and each corresponding distal control cord 41D of the first set of control cords are affixed to opposite edges of said first control bar driving wheel 79, thereby allowing said each first set proximate control cord 41P and each corresponding first set distal control cord 41D to move in opposite vertical directions when the first control bar 19 is rotated about its longitudinal axis. Likewise, an upper end (not shown) of each control cord of the second set of control cords 43 is connected to one of the second control cord driving wheels 81, such that each proximate control cord 43P and each corresponding distal control cord 43D of the second set of control cords are affixed to opposite edges of said second control bar driving wheel 81, thereby allowing said each second set proximate control cord 43P and each corresponding second set distal control cord 43D to move in opposite vertical directions when the second control bar 20 is rotated about its longitudinal axis. This allows an individual to control independently the amount of light passing between the longitudinal slats 39 of either the upper linear array of slats 39 associated with the upper region 38 of the opening 15 or the lower linear array of slats 39 associated with the lower region 40 of said opening 15.

For aesthetic purposes, there is still further provided in the venetian blind according to the present invention means for holding the first and second sets of control cords substantially adjacent to each other. Such means provides a more orderly appearance, especially when either of the linear arrays of slats is collapsed. In the illustrated embodiment of the venetian blind 13, said control cord holding means comprises a plurality of proximate circular washers 83 affixed simultaneously about the proximate control cords 41P and 43P of each of the first and second sets 41 and 43 of control cords, for holding each proximate control cord 41P of the first set of control cords 41 adjacent to the corresponding proximate control cord 43P of the second set of control cords 43. Further provided is a corresponding plurality of distal circular washers 85 affixed simultaneously about the distal control cords 41D and 43D of each of the first and second sets 41 and 43 of control cords for holding each distal control cord 41D of the first set of control cords 41 adjacent to the corresponding distal control cord 43D of the second set of control cords 43. It is preferred that each of said circular washers 83 and 85 is a flexible plastic washer which has a slit through one side thereof for ease of assembly with the blind 13, and further having an interior diameter which is sufficiently larger than the combined diameters of the control cords held therein, such that each of the control cords is allowed unrestricted vertical movement therethrough independent of the other control cord. Those skilled in the art will recognize that other elements exist which may perform substantially the same function as the circular washers 83 and 85. Some of these are discussed below as components of various other embodiments of the venetian blind according to the present invention.

FIGS. 5 through 8 illustrate an alternate embodiment of a venetian blind 113 according to the present invention, for selectively controlling the amount of light passing through an opening (not shown). Included in the venetian blind 113 is a control housing 117 attached to an upper edge (not shown) of the opening, a first control bar 119 and a parallel second control bar 120 in rotatable communication with suitable control bar mounting means, such as the planular bar mounts 121 affixed between to the distal surface of an elongate proximate side 123 and the proximate surface of an elongate distal side 124 of the control housing 117, each of said bar mounts 121 having at least a pair of apertures (not shown) therethrough for engaging the first and second control bars 119 and 120. The control bars 119 and 120 are substantially in a horizontal plane which is substantially perpendicular to the plane of the opening to which the venetian blind 113 is mounted. The elongate proximate side 123 is connected at each end to the proximate edges of a first housing end 125 and a second housing end 127. The elongate distal side 124 is connected at each end to the distal edges of said first housing end 125 and said second housing end 127. Further included in the elongate distal side 124 is means for attaching (not shown) the control housing 117 to the upper edge of the opening, such as that which is well known in the art. Still further included in the housing 117 is a rectangular lower side 126 affixed to the lower edges of each of the proximate and distal sides 123 and 124, and of the first and second housing ends 125 and 127.

Still further provided in the venetian blind 113 is first and second means for selectively limiting the amount of light passing through a first and a second region of the opening; each of said first or second light limiting means acting independent of the other. Each of said first and second light limiting means includes a plurality of co-planar, horizontal and parallel longitudinal slats 139 in communication with a first and second set of vertically oriented light-limiting control cords 141 and 143, respectively. Each of the longitudinal slats 139 is substantially equivalent in size and similar to the longitudinal slats 39 of the venetian blind 13. Each of the first and second sets of light limiting cords 141 and 143 includes at least a proximate cord (141P or 143P) in communication with the proximate edges of the slats 139, and a distal cord (141D or 143D) in communication with the distal edges of said slats 139.

Each of the first or second light limiting means of the venetian blind 113 further includes means for selectively retaining the plurality of longitudinal slats 139 in at least a first or a second linear array, respectively corresponding to said first region or second region of the opening. Said retaining means includes a plurality of horizontal connecting cords 155 for connecting at regular intervals each of the proximate control cords 141P and 143P to the corresponding distal control cord 141D or 143D, via detachable affixing means. Each of the horizontal connecting cords 155 further includes a proximate end 155P for detachably affixing to either of the corresponding proximate control cords 141P or 143P, a distal end 155D for detachably affixing to either of the corresponding distal control cords 141D or 143D, and a linear cord body 155B which is substantially as long as each longitudinal slat 139 is wide, for allowing one of said slats 139 to rest thereon. Such detachable affixing means allows the operator of the blind 113 to selectively vary the vertical length of each of the separate linear arrays of slats 39. Said detachable affixing means in this embodiment of the venetian blind 113 comprises ball and loop affixing means which incorporates a ball of semi-rigid material such as a plastic affixed at each end 155P and 155D of each horizontal connecting cord 155, for detachably engaging a corresponding horizontal connecting loop 156 affixed in each of the control cords 141P, 141D, 143P or 143D. The connecting cords 155 and connecting loops 156 are made of material substantially similar to that of the control cords 141 and 143. It is also preferred that each of the connecting loops 156 is affixed to the corresponding control cord 141 or 143 via automated weaving means, such as that which is common in the manufacture of similar cords for venetian blinds. Those skilled in the art will recognize, however, that a wide variety of both manual and automated affixing means exists which may just as readily be used to affix each of said connecting loops 156 to the appropriate control cord 141 or 143, according to the present invention.

Each of the first or second light limiting means of the venetian blind 113 further includes means for selectively collapsing (not shown) the first or second linear array of slats 139, which is substantially similar to that of the venetian blind 13, comprising a lifting cord (not shown) which is in communication with each slat 139 through at least a lifting cord aperture (not shown) similar to the aperture 57A of the blind 13. The lifting cord is affixed at a first end to the lowest slat of the blind (not shown), via means which are well known, and is further in communication with pulley means (not shown) similar to that of the blind 13 through a pair of lifting cord apertures 157A in the lower side 126 of the control housing 117. Said pulley means are affixed to the blind control housing such that said lowest slat is pulled toward the control housing by the lifting cord when a second end (not shown) of the lifting cord is pulled away from said control housing. Means for locking the lifting cord in place relative to said pulley means, such as that which are well known in the art, is further provided in the control housing. It is preferred that said lowest slat include a greater mass than each of the slats 139, for assuring that said lowest slat falls away from the control housing under the force of gravity when the lifting cord is released by said locking means, and the first end of the lifting cord is thereby allowed to follow the remaining portion of the lifting cord and move toward the control housing.

Still further included in each of the first or second light limiting means of the venetian blind 113 is means for selectively varying the amount of light passing between the slats of the corresponding first or second linear array of slats. In the venetian blind 113, said varying means includes first and second means for rotating the corresponding first or second control bar (119 or 120) about its longitudinal axis. Said first and second rotating means includes a first and second worm gear 167 and 169, for engaging a corresponding first and second worm driving wheel 171 and 173. Each of said driving wheels 171 and 173 is co-axially affixed to the corresponding first or second control bar 119 or 120, such that when either the first or second worm gears 167 or 169 is rotated, the corresponding first or second driving wheel 171 or 173 causes the corresponding first or second control bar 119 or 120 to rotate about its axis. Means for rotating the first or second worm gears 167 or 169 is further provided, said worm gear rotating means includes first and second apertured mounting arms 175 and 177 extending colinearly from the corresponding first or second worm gear 167 or 169 through the elongate proximate side 123 for engaging a corresponding rotatable light-varying bar (not shown), which is substantially similar to those that are well known in the art.

Said first and second light limiting means of the venetian blind 113 further includes a first and second pair of control cord driving cylinders 179 and 181, each of which is coaxially affixed to the corresponding first or second control bar 119 or 120. An upper end (not shown) of each control cord of the first set of control cords 141 is connected to one of the first control cord driving cylinders 179, such that each proximate control cord 141P and each corresponding distal control cord 141D of the first set of control cords 141 are affixed to opposite edges of said first control bar driving cylinder 179, thereby allowing said each first set proximate control cord 141P and each corresponding first set distal control cord 141D to move in opposite vertical directions when the first control bar 119 is rotated about its longitudinal axis. Likewise, an upper end (not shown) of each control cord of the second set of control cords 143 is connected to one of the second control cord driving cylinders 181, such that each proximate control cord 143P and each corresponding distal control cord 143D of the second set of control cords 143 is affixed to opposite edges of said second control bar driving cylinder 181, thereby allowing said each second set proximate control cord 143P and each corresponding second set distal control cord 143D to move in opposite vertical directions when the second control bar 120 is rotated about its longitudinal axis. This allows an individual to control independently the amount of light passing between the longitudinal slats 139 of either the upper linear array of slats 139 associated with the upper region of the opening or the lower linear array of slats 139 associated with the lower region of said opening.

Similar to the venetian blind 13, the venetian blind 113 includes means for holding the first and second sets of control cords 141 and 143 substantially adjacent to each other, for providing a more orderly appearance. In the illustrated embodiment of the venetian blind 113, said control cord holding means comprises a plurality of proximate circular loops 183 and distal cord loops 185 affixed at regular intervals to each of the corresponding proximate control cords 141P and 143P and distal control cords 141D and 143D substantially adjacent to each of the horizontal connecting loops 156, for holding the adjacent control cord substantially close by. It is preferred that each of said circular cord loops 183 and 185 is made of a material substantially similar to that comprising the control cords, and further includes an interior loop diameter which is sufficiently larger than the diameter of the control cord held therein, such that each of the control cords is allowed unrestricted vertical movement therethrough independent of the other control cord. It is also preferred that each of the circular cord loops 183 and 185 is affixed via automated weaving means, such as that which is common in the manufacture of similar cords for venetian blinds. Those in the art will recognize, however, that a wide variety of both manual and automated affixing means exists which may just as readily be used to affix each of said cord loops 183 and 185 to the appropriate control cord, according to the present invention.

Figure 9:
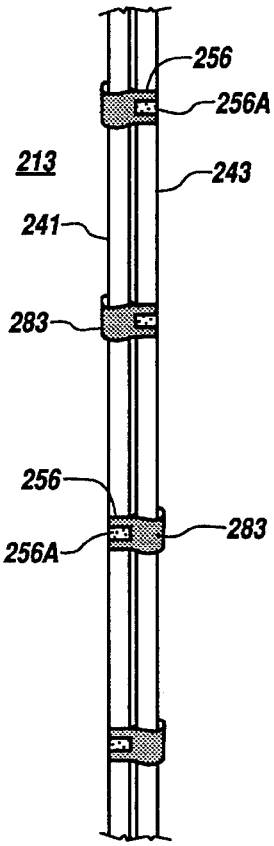
FIG. 9 is a partial front elevational view of an alternate embodiment of a pair of control cords for a venetian blind according to the present invention.
Figure 10:
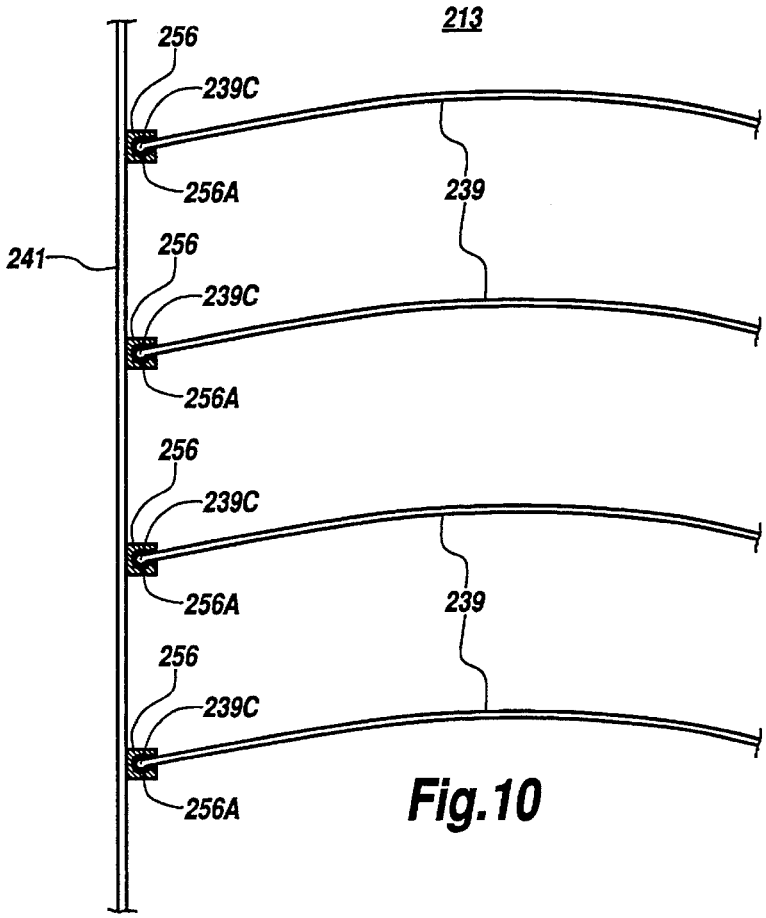
FIG. 10 is a partial side elevational view of the embodiment of a pair of control cords for a venetian blind of FIG. 9, connected to a plurality of an embodiment of longitudinal slats according to the present invention.

In FIGS. 9 and 10 is illustrated another embodiment of a venetian blind 213 including a first and second set of control cords 241 and 243, respectively, which are each connected to a corresponding rotatable horizontal control bar (not shown) similar to that of the control bars 19 and 20 of blind 13 or bars 119 and 120 of blind 113, and linear array retaining means for use with a control housing (not shown) in which is affixed said control bars, according to the present invention. In this embodiment of the venetian blind 213, the first and second sets of control cords are not cylindrical cords, but rather are made of elongate strips of cloth tape. Also, instead of the linear array retaining means incorporating additional cord-like elements such as the horizontal connecting cords 55 and 155 for connecting the corresponding proximate and distal cords of each set 241 or 243 of control cords, the venetian blind 213 makes use of an alternate design of longitudinal slats 239, which incorporates means for detachably affixing each of the longitudinal edges of each of a plurality of elongate longitudinal slats 239 (said slats 239 being substantially similar to the slats 39 of the venetian blind 13) to one or more of the control cords 241 or 243. Said alternate design incorporates cylindrical longitudinal edges 239C which have a diameter greater than the distance between the upper and lower surfaces of each slat 239. Said cylindrical longitudinal edges 239C are for detachably engaging a plurality of slat retaining nuts 256.

Each of the nuts 256 is affixed to the slat-facing surface of one of the control cords 241 and 243 via detachable affixing means which are well known, such as hook and loop fastener means or the application of a film forming adhesive between the nut 256 and the adhering surface of the control cords 241 and 243. This allows the nuts 256 which are not being used for retaining one of the linear arrays of slats 239, to be removed from the control cords 241 and 243, and thereby allowing the venetian blind 213 to be collapsible into a smaller form. Each of said nuts 256 further includes a bore 256A therethrough and an opening between the bore 256A and the exterior surface of the nut 256 which is facing the linear array of blinds 239. The diameter of said bore 256A is slightly larger than that of the cylindrical longitudinal edges 239C for pivotally engaging same. The nuts 256 are made of a semi-rigid material for allowing flexible cooperation with the cylindrical longitudinal edges 239C upon insertion or extraction of said edges 239C from the bores 256A.

Similar to the venetian blinds 13 and 113, the venetian blind 213 includes means for holding the first and second sets of control cords 241 and 243 substantially adjacent to each other, for providing a more orderly appearance. In the illustrated embodiment of the venetian blind 213 (FIG. 9), said control cord holding means comprises a plurality of proximate and distal circular loops 283 affixed via suitable affixing means at regular intervals to each of the corresponding first and second sets of control cords 241 and 243 substantially adjacent to each of the slat retaining nuts 256, for holding the adjacent control cord substantially close by. It is preferred that each of said circular cord loops 283 is made of a material substantially similar to that comprising the control cords, and further includes an interior loop diameter which is sufficiently larger than the diameter of the control cord held therein, such that each of the control cords is allowed unrestricted vertical movement therethrough independent of the other control cord to which the circular cord loop 283 is affixed. Those in the art will recognize, that a wide variety of both manual and automated affixing means exists which may be readily be used to affix each of said cord loops 283 to the appropriate control cord, according to the present invention.

Also similar to the blind 13, the venetian blind 213 comprises a lifting cord (not shown) which is in communication with each slat 239 through at least a lifting cord aperture (not shown) similar to the aperture 57A of blind 13. The lifting cord is affixed at a first end to the lowest slat of the blind (not shown), via means which are well known, and is further in communication with pulley means similar to that of the blind 13 which are affixed to the blind control housing (not shown) such that said lowest slat is pulled toward the control housing by the lifting cord when a second end (not shown) of the lifting cord is pulled away from said control housing. Means for locking the lifting cord in place relative to said pulley means, such as that which are well known in the art, is further provided in the control housing. It is preferred that said lowest slat include a greater mass than each of the slats 239, for assuring that said lowest slat falls away from the control housing under the force of gravity when the lifting cord is released by said locking means, and the first end of the lifting cord is thereby allowed to follow the remaining portion of the lifting cord and move toward the control housing.

Figure 11:
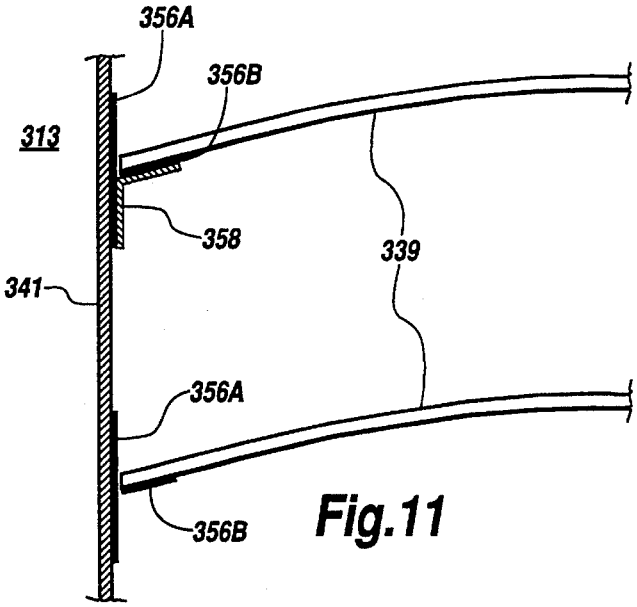
FIG. 11 is a side elevational view of an alternate embodiment of a control cord for a venetian blind, connected to, or otherwise in communication with, a plurality of an alternate embodiment of longitudinal slats, according to the present invention.

Illustrated in FIG. 11 is yet another embodiment of a venetian blind 313 according to the present invention, which includes a first set 341 and second set (not shown) of control cords which are each connected to a corresponding rotatable horizontal control bar (not shown) similar to that of the control bars 19 and 20 of blind 13 or bars 119 and 120 of blind 113, and linear array retaining means for use with a control housing (not shown) in which is affixed said control bars, according to the present invention. In this embodiment of the venetian blind 313, the first and second sets of control cords are made of elongate strips of cloth tape. Also, the venetian blind 313 makes use of adhesive strips of a flexible substrate material incorporating hook and loop fastener means for detachably affixing to one or more of the control cords each longitudinal edge of a plurality of elongate longitudinal slats 339. Said slats 339 are substantially similar to the slats 39 of the venetian blind 13, except that no lifting cord apertures 57A are necessary. Attached at regular intervals to the interior surface of each of the control cords via a suitable adhesive is a plurality of first flexible retaining elements 356A, each of which includes a first hook and loop fastener means on its slat facing surface. Attached along the lower surface of each longitudinal edge of the longitudinal slats 313 via a suitable adhesive is a corresponding plurality of second flexible retaining elements 356B, which are substantially similar to the first flexible retaining elements 356A. Further provided for detachably engaging the first and second flexible retaining elements 356A and 356B is a plurality of flexible removable retaining elements 358, which include a second hook and loop fastener means affixed to on of two oppositely disposed surfaces, for removably engaging the first hook and loop fastener means of the first and second flexible retaining elements 356A and 356B. Each of said removable retaining elements 358 may be selectively affixed between a first flexible retaining element 356A and a second flexible retaining element 356B for communicating with the peripheral edges of one of the slats 339.

Also, similar to the blind 13, the venetian blind 313 comprises a lifting cord (not shown) which is in communication with each slat 339 through at least a lifting cord aperture (not shown) similar to the aperture 57A of blind 13. The lifting cord is affixed at a first end to the lowest slat of the blind (not shown), via means which are well known, and is further in communication with pulley means similar to that of the blind 13 which are affixed to the blind control housing (not shown) such that said lowest slat is pulled toward the control housing by the lifting cord when a second end (not shown) of the lifting cord is pulled away from said control housing. Means for locking the lifting cord in place relative to said pulley means, such as that which are well known in the art, is further provided in the control housing. It is preferred that said lowest slat include a greater mass than each of the slats 339, for assuring that said lowest slat falls away from the control housing under the force of gravity when the lifting cord is released by said locking means, and the first end of the lifting cord is thereby allowed to follow the remaining portion of the lifting cord and move toward the control housing.

As well, similar to the venetian blinds 13, 113 and 213, it is preferred that the venetian blind 313 further include means for holding the adjacent sets of control cords 341 substantially adjacent to each other, for providing a more orderly appearance. Said means may comprise circular cord loops substantially similar to the cord loops 283 of the venetian blind 213, or various other elements which those skilled in the art will recognize as being able to accomplish substantially the same function.

Figure 12:
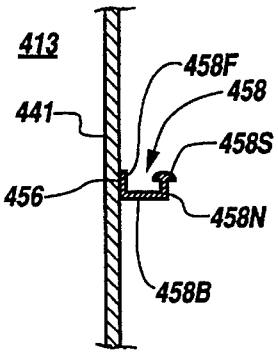
FIG. 12 is a side elevational view of an alternate embodiment of a control cord for a venetian blind according to the present invention.
Figure 13:
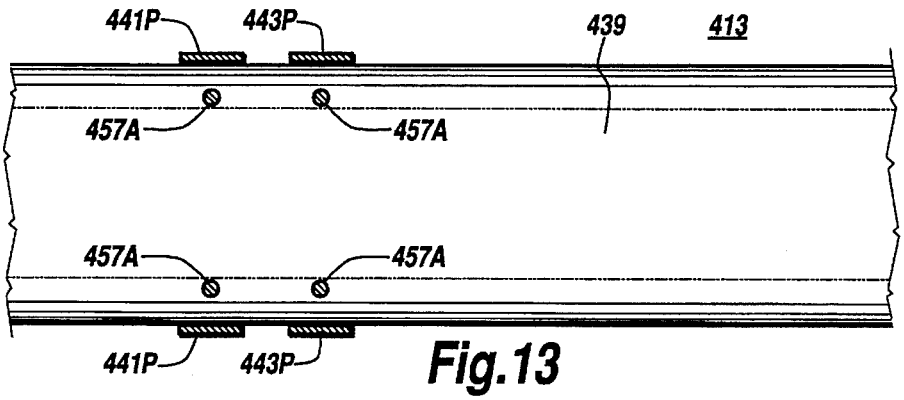
FIG. 13 is a top sectioned view of a plurality of control cords substantially similar to that of FIG. 12, connected to, or otherwise in communication with, an alternate embodiment of a longitudinal slat according to the present invention.

Illustrated in FIG. 12 and 13 is still yet another embodiment of a venetian blind 413 according to the present invention, which includes a first and a second set of vertically oriented light-limiting control cords 441 and 443, respectively, which are each connected at an upper end to a corresponding rotatable horizontal control bar (not shown) similar to that of the control bars 19 and 20 of blind 13 or bars 119 and 120 of blind 113; a plurality of elongate slats 439; and means for retaining said plurality of slats 439 in at least a linear array. The control cords 441 and 443 are further slidably connected at a lower end to a lowest slat (not shown) of the blind. In this embodiment of the venetian blind 413, the first and second sets of control cords 441 and 443 are made of elongate strips of cloth tape, similar to that found in the venetian blinds 213 and 313, which are each connected to a corresponding rotatable horizontal control bar (not shown) similar to that of the control bars 19 and 20 of blind 13 or bars 119 and 120 of blind 113. As well, the venetian blind 413 makes use of a plurality of U-shaped snapable fasteners 458 for detachably affixing each longitudinal edge of a plurality of elongate slats 439 to one or more of the control cords 441 or 443. The slats 439 are substantially similar to the slats 339 of the venetian blind 313, except that there is further provided in each slat 439 a plurality of snap apertures 457A for communicating with said snapable fasteners 458. The snapable fasteners 458 are affixed at regular intervals to the slat-facing surface of each of the control cords 441 and 443 via suitable affixing means, such as an adhesive. Each of the fasteners 458 is further made of a semi-rigid and flexible plastic material, and includes: a vertically oriented substantially rectangular control-cord-side-end 458F for affixing to one of the control cords; a substantially horizontal planular base 458B connected at one end to the lower edge of the control-cord-side-end 458F such that it extends at a substantially perpendicular angle from the control cord 451 or 453 toward the corresponding slat 439 when the snapable fastener 458 is in operable position affixed to said control cord 441 or 443; a substantially cylindrical vertically oriented neck 458N connected at one end to, and extending upward from, the other end of the base 458B; and a horizontal circular snap 458S affixed to the upward end of the neck 458N for detachably engaging one of the plurality of snap apertures 457A located along the longitudinal edges of each slat 439.

Also similar to the blind 13, the venetian blind 413 comprises a lifting cord (not shown) which is in communication with each slat 439 through at least a lifting cord aperture (not shown) similar to the aperture 57A of blind 13. The lifting cord is affixed at a first end to the lowest slat of the blind (not shown), via means which are well known, and is further in communication with pulley means similar to that of the blind 13 which are affixed to the blind control housing (not shown) such that said lowest slat is pulled toward the control housing by the lifting cord when a second end (not shown) of the lifting cord is pulled away from said control housing. Means for locking the lifting cord in place relative to said pulley means, such as that which are well known in the art, is further provided in the control housing. It is preferred that said lowest slat include a greater mass than each of the slats 439, for assuring that said lowest slat falls away from the control housing under the force of gravity when the lifting cord is released by said locking means, and the first end of the lifting cord is thereby allowed to follow the remaining portion of the lifting cord and move toward the control housing.

As well, similar to the venetian blinds 13, 113, 213 and 313, it is preferred that the venetian blind 413 further include means for holding the adjacent sets of control cords 441 and 443 substantially adjacent to each other, for providing a more orderly appearance. Said means may comprise circular cord loops substantially similar to the cord loops 283 of the venetian blind 213, or various other elements which those skilled in the art will recognize as being able to accomplish substantially the same function.

Figure 14:
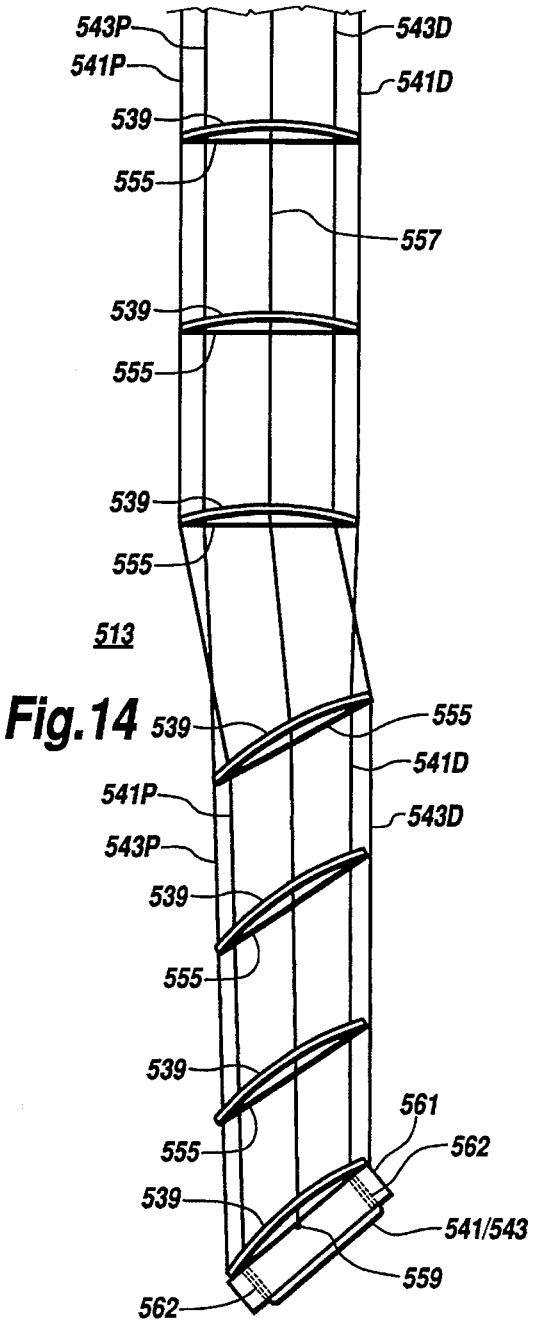
FIG. 14 is a side elevational view of yet another embodiment of the venetian blind according to the present invention.
Figure 15:
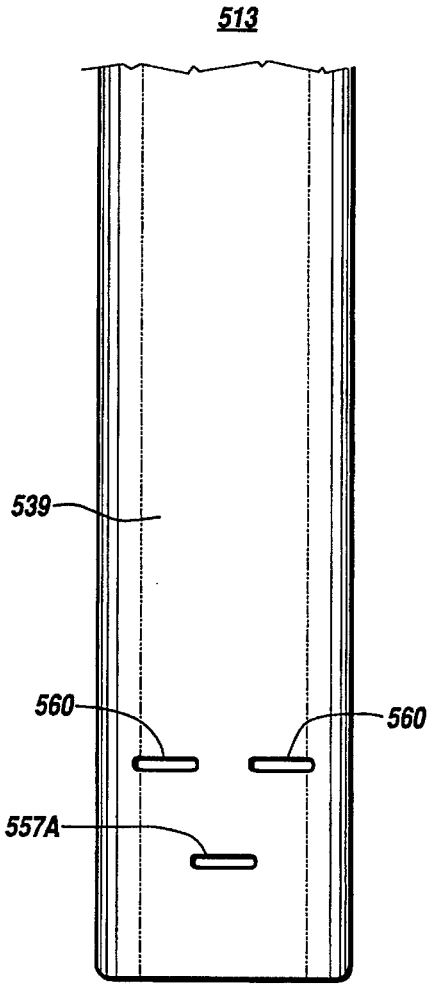
FIG. 15 is a partial top elevational view of a venetian blind slat of the embodiment of the venetian blind of FIG. 14.

In FIGS. 14 and 15 is illustrated yet still another embodiment of a venetian blind 513 according to the present invention, which includes: a first and second set of vertically oriented light-limiting control cords 541 and 543 respectively, which are each connected at an upper end to a corresponding rotatable horizontal control bar (not shown) similar to that of the control bars 19 and 20 of blind 13 or bars 119 and 120 of blind 113; a plurality of elongate slats 539; and means for retaining said plurality of slats 539 in at least a linear array. The control cords 541 and 543 are further slidably connected at a lower end to a lowest slat 561 of the blind via vertically oriented apertures 562. In this embodiment of the venetian blind 513, the first and second sets of control cords 541 and 543 are substantially similar to the first and second sets of control cords 41 and 43 of the venetian blind 13. Each set of control cords 541 and 543 includes a plurality of horizontal connecting cords 555, which are similar to the connecting cords 55 of the blind 13, for connecting at regular intervals each of the proximate control cords 541P and 543P to the corresponding distal control cord 541D or 543D. Each of the connecting cords 555 is substantially as long as each longitudinal slat 539 is wide, for allowing one of said slats 539 to rest thereon, between the proximate and distal cords of said control cord set. As with the blind 13, a portion of said plurality of horizontal connecting cords 555 is affixed to each control cord set 541 or 543 in a region of the blind where the corresponding control cord set 543 or 541 has no connecting cords 555, for allowing each set of control cords 541 or 543 to control a separate linear array of the slats 539. The connecting cords 555 are made of material substantially similar to that of the control cords 541 and 543, and are affixed to the control cords 541 and 543 via affixing means which are well known.

Also similar to the blind 13, the venetian blind 513 comprises a lifting cord 557 which is in communication with each slat 539 through at least a lifting cord aperture 557A which is located substantially along the longitudinal axis of each slat 539. The lifting cord 557 is affixed at a first end 559 to the lowest slat 561 of the blind 513, via means which are well known. The lifting cord 557 is further in communication with pulley means similar to that of the blind 13, which are affixed to the blind control housing (not shown) such that said lowest slat 561 is pulled toward the control housing by the lifting cord 557 when a second end (not shown) of the lifting cord 557 is pulled away from said control housing. Means for locking the lifting cord in place relative to said pulley means, such as that which are well known in the art, is further provided in the control housing. It is preferred that said lowest slat 561 include a greater mass than each of the slats 539, for assuring that said slat 561 falls away from the control housing under the force of gravity when the lifting cord 557 is released by said locking means, and the first end 559 of the lifting cord 557 is thereby allowed to follow the remaining portion of the lifting cord 557 and move toward the control housing.

Unlike the venetian blinds 13, 113, 213, 313 and 413, the venetian blind 513 does not include as a component of the control cords 541 and 543 means for holding the adjacent sets of control cords 541 and 543 substantially adjacent to each other. Rather, the venetian blind 513 incorporates a different method of holding the slack portion of each control cord set 541 or 543 near the slats 539 for providing the blind 513 with a neat and uniform appearance. Said different method includes providing a plurality of elongate control cord apertures 560 in the slats 539. Each of said control cord apertures 560 has an axis which is substantially perpendicular to that of the corresponding slat 539, and is located between the longitudinal edge of said slat 539 and the longitudinal axis of said slat 539. The portion of each set of control cords 541 or 543 which does not include a plurality of connecting cords 555, is in communication with the control cord apertures 560 of each slat 539 which is not held by said connecting cords 555, and is thereby held within the plane of said slats 539.

The inventor has given a non-limiting description of several embodiments of the present invention, to which many changes may be made without deviating from the spirit of the invention. While this invention has been described with reference to illustrative embodiments, this description is not intended to be construed in a limiting sense. Various modifications and combinations of the various embodiments as well as other embodiments of this invention will be apparent to a person skilled in the art upon reference to this description. It is therefore contemplated that the appended claims cover any such modifications and/or embodiments that fall within the true scope of the present invention.

It is claimed:

1. A venetian blind, comprising:

a control housing;

a first array of slats suspended from the control housing;

a second array of slats suspended from the control housing below the first array of slats;

a lifting cord for raising and lowering the slats;

a first set of control cords for opening and closing the first array of slats, including a proximate control cord and a distal control cord;

a second set of control cords for opening and closing the second array of slats, including a proximate control cord and a distal control cord;

holding means for holding the two proximate control cords adjacent to one another and for holding the two distal control cords adjacent to one another as the slats in the first array are raised.

2. A venetian blind as recited in claim 1, wherein the holding means comprises a plurality of washers for holding the two proximate control cords adjacent to one another and a plurality of washers for holding the two distal control cords adjacent to one another.

3. A venetian blind as recited in claim 1, wherein the holding means comprises a plurality of loops attached to one of the proximate control cords and a plurality of loops attached to one of the distal control cords.

4. A venetian blind, comprising:

a control housing;

an array of slats suspended from the control housing, wherein each slat has a pair of cylindrical longitudinal edges extending substantially the length of the slat;

a set of control cords for opening and closing the array of slats; and a plurality of slat retaining nuts attached to the control cords for engaging the cylindrical longitudinal edges of the slats.

5. A venetian blind as recited in claim 4, wherein the slat retaining nuts are detachable from the control cords.

6. A venetian blind as recited in claim 5, wherein the slat retaining nuts are attached to the control cords by hook and loop fasteners.

7. A venetian blind as recited in claim 5, wherein the slat retaining nuts are attached to the control cords by a film forming adhesive.

8. A venetian blind, comprising:

a control housing;

a first array of slats suspended from the control housing;

a second array of slats suspended from the control housing below the first array of slats;

a lifting cord for raising and lowering the slats;

a first set of control cords for opening and closing the first array of slats, including a proximate control cord and a distal control cord; and a second set of control cords for opening and closing the second array of slats, including a proximate control cord and a distal control cord, wherein the second set of control cords pass through apertures in the slats in the first array.

9. A venetian blind as recited in claim 8, wherein the first set of control cords pass through apertures in the slots in the second array.

10. A venetian blind as recited in claim 8, wherein the lifting cord passes through apertures in the slats in the first array and through apertures in the slats in the second array.

* * * * *